US006384359B1

(12) United States Patent
Belcastro et al.

(10) Patent No.: US 6,384,359 B1
(45) Date of Patent: May 7, 2002

(54) INSPECTION SYSTEM

(75) Inventors: Marc D. Belcastro, Glen Allen; Loren Duvekot, Goochland, both of VA (US); Mark Widenhouse, Mt. Pleasant, NC (US); Renee R. Cooper, Concord, NC (US); Nathan C. Edwards, Salisbury, NC (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/738,674

(22) Filed: Dec. 15, 2000

(51) Int. Cl.[7] ..... B07C 5/34

(52) U.S. Cl. ..... 209/536; 209/588; 131/905; 131/907

(58) Field of Search ..... 209/536, 588, 209/535; 356/239; 137/905, 906, 907, 908

(56) References Cited

U.S. PATENT DOCUMENTS

| | | | | | |
|---|---|---|---|---|---|
| 2,932,391 | A | * | 4/1960 | Broekhuysen | 131/906 |
| 2,984,352 | A | * | 5/1961 | Gilman | 131/906 |
| RE28,931 | E | * | 8/1976 | Lehmann | 209/74 |
| 4,377,743 | A | | 3/1983 | Bolt et al. | |
| 4,644,150 | A | * | 2/1987 | Kuga et al. | 250/223 |
| 4,805,641 | A | | 2/1989 | Radzio et al. | |
| 4,986,285 | A | * | 1/1991 | Radzio et al. | 131/280 |
| 5,000,323 | A | * | 3/1991 | Cahill et al. | 209/536 |
| 5,010,904 | A | * | 4/1991 | Lassiter | 131/280 |
| 5,024,333 | A | * | 6/1991 | Brink et al. | 209/535 |
| 5,406,376 | A | * | 4/1995 | Maiwald et al. | 356/237 |
| 5,423,128 | A | * | 6/1995 | Moore, Jr. et al. | 33/488 |
| 5,583,633 | A | | 12/1996 | Matsumura et al. | |
| 5,797,406 | A | * | 8/1998 | Dawson | 131/84.1 |
| 6,037,591 | A | * | 3/2000 | Neri et al. | 250/341.1 |
| 6,075,882 | A | * | 6/2000 | Mullins et al. | 382/141 |
| 6,264,591 | B1 | * | 7/2001 | Keen et al. | 493/4 |
| 6,276,366 | B1 | * | 8/2001 | Fuchigami et al. | 131/280 |

* cited by examiner

*Primary Examiner*—Donald P. Walsh
*Assistant Examiner*—Daniel K. Schlak
(74) *Attorney, Agent, or Firm*—Connolly Bove Lodge & Hutz LLP

(57) ABSTRACT

An inspection system detects the presence or absence of desired components of an assembled cigarette after tipping paper has been applied to join a multi-component filter to a tobacco rod. A transport moves the assembled cigarettes having multi-component filters along a high speed path of travel. At a first inspection station a transverse detection beam is directed through each cigarette in the area of the multi-component filter. A second inspection station directs a longitudinal detection beam toward an end filter component along a path substantially parallel to the longitudinal axis of the cigarette. Control circuitry allows an assembled cigarette to continue along the high speed path of travel when the second inspection station detects the presence of an end filter component unless beforehand the first inspection station fails to detect the presence of an internal filter component in which case the second inspection is withheld and the cigarette is removed from the high speed path of travel.

10 Claims, 2 Drawing Sheets

INSPECTION SYSTEM

BACKGROUND OF THE INVENTION

The present invention relates to an inspection system, and more particularly to a cigarette inspection system for primarily detecting the presence or absence of internal and end filter components after the cigarette is fully assembled.

In today's cigarette manufacturing machinery, inspection devices have been proposed that inspect for missing cigarette filters and missing filter segments on cigarettes that require "combined" or multiple component filters. For the most part these inspection systems either inspect for the filter segment prior to the final assembly of the cigarette components, i.e., application of the tipping paper, or inspect only the exposed visible filter end of a completely assembled cigarette. However, once the final assembly step of applying tipping paper is carried out, internal filter component or components are sandwiched between the cigarette tobacco rod and the outer filter component, and these internal filter components are not visible.

Inspecting for the presence or absence of internal filter components after the final assembly of the cigarette, i.e., after tipping paper has been applied, is believed to be the only way to achieve 100% confidence that internal filter components are in fact in place. This is because inspection sensors positioned earlier in the cigarette assembly or filter inspection process fail to provide such confidence as missing internal filter components may occur during the process of applying the tipping paper. Accordingly, inspecting for internal filter components after being surrounded by the tipping paper is the only way of assuring with a high level of confidence that no cigarette with a missing component is forwarded downstream of the cigarette-making machinery.

SUMMARY OF THE INVENTION

Accordingly, one of the objects of the present invention is an inspection system that inspects for the presence or absence of an internal filter component after the tipping paper has been applied.

Another object of the present invention is an inspection system which is simple in operation but highly effective and reliable in removing selected cigarettes from a very high speed stream of cigarettes during production thereof.

Another object of the present invention is a cigarette inspection system that uses sensors to inspect through the tipping paper for the presence or absence of internal filter components in a completely assembled cigarette.

Still another object of the present invention is an inspection system that inspects for the presence or absence of a visible end filter component as well as an internal filter component.

BRIEF DESCRIPTION OF THE DRAWINGS

Novel features and advantages of the present invention in addition to those mentioned above will be readily apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
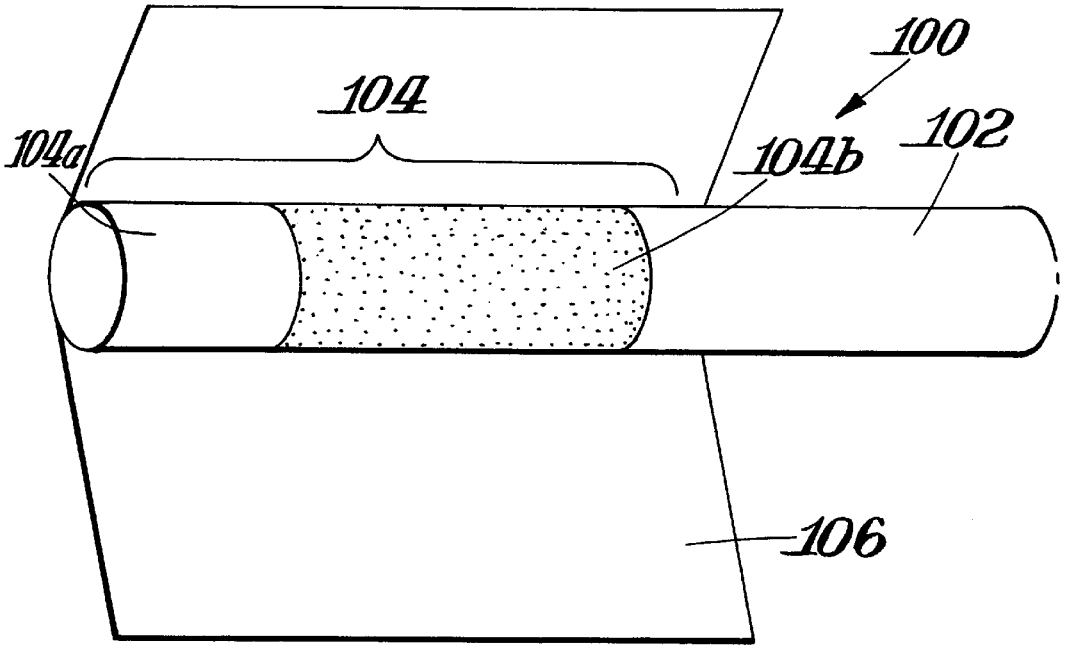
FIG. 1 is a modified cutaway view of a multi-component filter cigarette.

Referring in more particularity to the drawings, FIG. 1 illustrates a multi-component filter cigarette 100. Cigarette 100 is comprised of a tobacco rod 102 held in abutting contact with a multi-component filter 104 by overwrapping tipping paper 106. In this preferred embodiment, multi-component filter 104 is comprised of two components, an internal filter segment 104*b* which contains a particulate matter and an end filter component 104*a* which may be comprised of a material such as cellulose acetate. The particulate matter in internal filter component 104*b* may be comprised of activated carbon but could be comprised of other materials as selected by one of ordinary skill. It is readily apparent that once tipping paper 106 is wrapped around tobacco rod 102 and multi-component filter 104 it is be impossible to determine from an external visual inspection whether internal filter component 104*b* is present or not.

Figure 2:
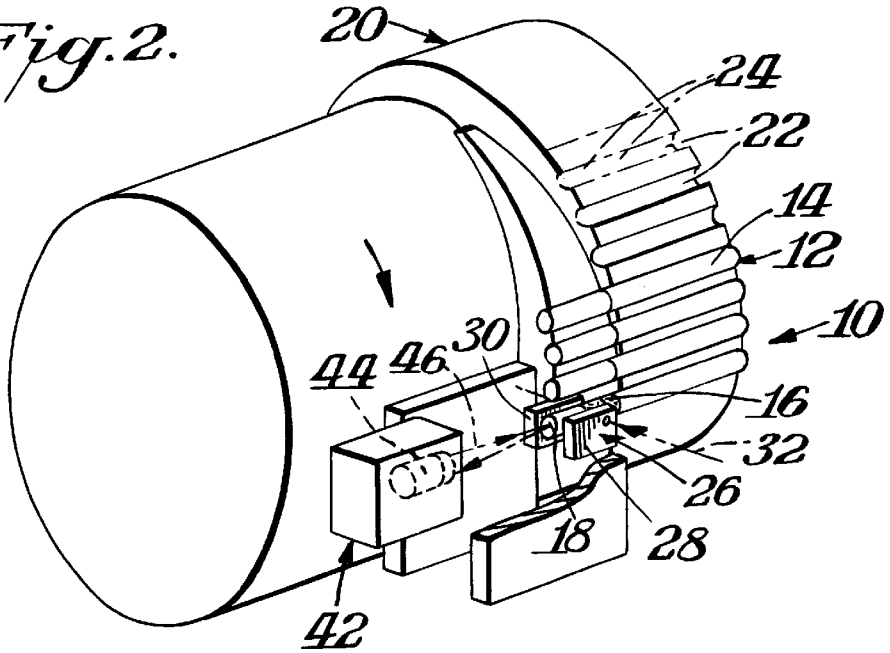
FIG. 2 is a perspective view of a cigarette transport drum and an inspection system for detecting missing filter components, according to the present invention.

FIG. 2 illustrates an inspection system 10 for detecting the presence or absence of both internal and end filter components of an assembled cigarette 12 after tipping paper 14 has been applied. For purposes of illustration, the filter components of cigarette 12 are shown as comprising an internal component 16 and an end component 18 of cellulose acetate. Internal component 16 may contain a particulate material such as charcoal, for example. Other filter arrangements may be tested on the inspection system 10 where such filters include both internal and end components.

Assembled cigarettes 12 travel along a high speed path that includes the exterior surface of a rapidly rotating transport drum 20. The outer surface of the drum includes a plurality of closely spaced grooves 22, and cigarettes rest within these grooves. Suction applied through ports 24 holds the cigarettes within the grooves, as is well known.

Figure 3:
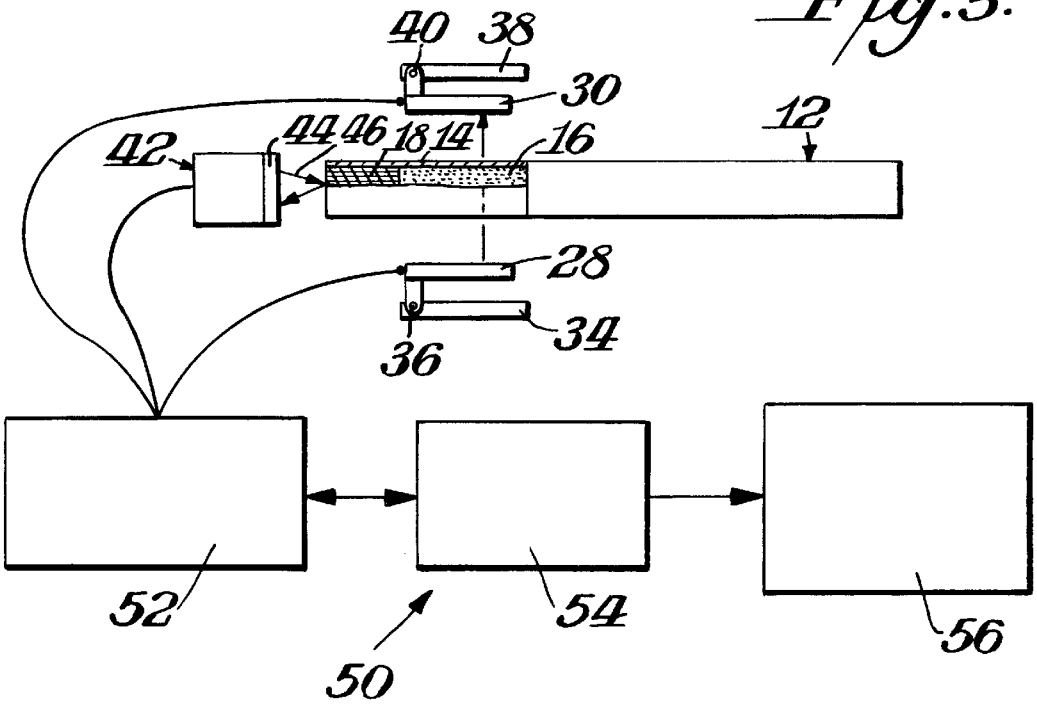
FIG. 3 is a schematic view illustrating an electronic control for the inspection system shown in FIG. 2, according to the present invention.

As shown in FIGS. 2 and 3, inspection system 10 includes a first inspection station 26 comprising an infrared emitter 28 and an infrared receiver 30 positioned on opposite sides of the high speed path of travel of the assembled cigarettes 12. Emitter 28 directs a transverse detection beam 32 through each cigarette in the area of the internal filter component 16 to detect the presence or absence of that filter component. A mounting 34 and connection 36 function to secure emitter 28 in place, and a similar mounting plate 38 and connection 40 function to secure receiver 30 in place.

A second inspection station 42 is positioned slightly downstream from first inspection station 28. Second inspection station 42 comprises a optical sensor 44 which directs a longitudinal detection beam 46 toward the end filter component 18 along a path substantively parallel to the longitudinal axis of the assembled cigarette being inspected.

A control arrangement 50 is used to operate the first and second inspection stations and to remove selected cigarettes from the high speed path of travel when the absence of at least one filter component is detected. In the illustrated embodiment, control 50 collectively comprises signal conditioning system 52, machine control 54 and, optionally, data collection system 56. Signal conditioning system 52 buffers incoming signals from sensors 28,30 and modifies the signals to fashion an appropriate output signal for use by machine control 54. Control 50 allows an assembled cigarette 12 to continue along the high speed path of travel when optical sensor 44 of the second inspection station detects the presence of end filter component 18. Machine control 54 develops a signal that causes the inspected cigarette to be held in the transport 20 if the end filter component 18 is present and develops a different signal causing the cigarette 12 to be removed from the transport if the end filter component 18 is missing. The first of the aforementioned signals is generated unless beforehand first inspection station 26 located slightly upstream fails to detect the presence of internal filter component 16. Under those conditions, the signal that would result from the successful inspection for the end filter component is withheld, and the selected cigarette is removed from the high speed path of travel.

Data collection system 56 counts the number of cigarettes removed from the high speed path of travel and categorizes the cause of each removal. This information is stored in a memory device or site for later analysis. It will be readily understood that the practice of the present invention does not require the use of data collection system 56 and that its presence or absence may be selected as need by one of ordinary skill.

Basically, if the optical sensor 44 detects the presence of end filter component 18, a signal is generated which maintains the finished cigarette in the transport drum and ultimately permits the cigarette to remain in the high speed path of travel. On the other hand, if optical sensor 44 does not detect end filter component 18, a signal is generated which ultimately leads to removal of the cigarette from the transport drum. Both the first and second inspection stations operate independently of one another except when the first inspection station 26 determines that assembled cigarette 12 does not have a desired internal filter component. Under these conditions, the control 50 withholds the signal from the optical sensor 44 which would otherwise permit the cigarette to remain on its high speed path of travel. When control 50 fails to receive a signal from the optical sensor, the cigarette is rejected.

It is significant that the first inspection station does not generate a signal that directly interfaces with the control that rejects a cigarette. Instead, the first inspection station causes the rejection of a cigarette indirectly by causing any signal from the optical sensor 44 of the second inspection station 42 to be withheld. This particular approach has advantages in that the amount of reprogramming or alteration to control 50 is significantly minimized. Additionally, this approach permits the first inspection station to be positioned quite close to optical sensor 44. In a preferred embodiment, the first inspection station is positioned only approximately four degrees upstream and away from optical sensor 44. With the first inspection station positioned so close to the point on transport drum 20 at which the selected cigarette is rejected, there would not be enough time to sense such a cigarette and reject that cigarette before being transported downstream. Another advantage is that this approach eliminates the need for a separate control that would activate the cigarette rejection system of the transport drum responsive to an appropriate signal from the first inspection station.

We claim:

1. An inspection system for detecting the presence or absence of desired components of an assembled cigarette, the inspection system comprising (a) a transport for moving assembled cigarettes along a high speed path of travel, (b) a first inspection station constructed and arranged to direct a transverse detection beam through each cigarette in the area of an internal filter component, (c) a second inspection station constructed and arranged to direct a longitudinal detection beam toward an end filter component along a path substantially parallel to a longitudinal axis of the cigarette, and (d) a control constructed and arranged to allow an assembled cigarette to continue along the high speed path of travel when the second inspection station detects the presence of an end filter component unless beforehand the first inspection station fails to detect the presence of an internal filter component in which case the second inspection is withheld and the cigarette is removed from the high speed path of travel.

2. An inspection system as in claim 1 wherein the first inspection station includes an infrared emitter and an infrared receiver with the emitter and receiver positioned on opposite sides of the high speed path of travel.

3. An inspection system as in claim 1 wherein the second inspection station includes an optical sensor.

4. An inspection system as in claim 1 wherein the transport includes a rotating drum with cigarette receiving grooves on the exterior thereof.

5. An inspection system as in claim 4 wherein the first and second inspection stations are closely spaced apart adjacent the rotating drum with the first inspection station approximately four degrees upstream and away from the second inspection station.

6. A method for detecting the presence or absence of desired components of an assembled cigarette comprising the steps of (a) moving assembled cigarettes along a high speed path of travel, (b) conducting a first inspection by directing a transverse detection beam through each cigarette in the area of an internal filter component, (c) conducting a second inspection by directing a longitudinal detection beam toward an end filter component along a path substantial parallel to a longitudinal axis of the cigarette, and (d) allowing an assembled cigarette to continue along the high speed path of travel when the second inspection detects the presence of an end filter component unless beforehand the first inspection fails to detect the presence of an internal filter component in which case operation of the second inspection is affected such that the cigarette is removed from the high speed path of travel.

7. A method as in claim 6 wherein the transverse detection beam of the first inspection is an infrared beam.

8. A method as in claim 6 wherein the longitudinal detection beam of the second inspection is an optical beam.

9. A method as in claim 6 wherein the high speed path of travel of assembled cigarettes includes a curved portion, and the first and second inspections are sequentially conducted next to the curved portion of the high speed path of travel.

10. A method as in claim 9 including the step of conducting the first inspection approximately four degrees upstream and away from conducting the second inspection.

* * * * *